US008322103B1

(12) United States Patent
Kownacki

(10) Patent No.: US 8,322,103 B1
(45) Date of Patent: Dec. 4, 2012

(54) FAUX BRICK WITH SUSPENSION SYSTEM

(76) Inventor: Charles D Kownacki, Erie, PA (US)

( * ) Notice: Subject to any disclaimer, the term of this patent is extended or adjusted under 35 U.S.C. 154(b) by 823 days.

(21) Appl. No.: 12/288,697

(22) Filed: Oct. 22, 2008

(51) Int. Cl.
*E04B 2/90* (2006.01)
*E04B 2/82* (2006.01)

(52) U.S. Cl. ..... 52/506.05; 52/235; 52/243; 52/511; 52/489.2

(58) Field of Classification Search ..... 52/235, 52/243, 506.05, 489.1, 281, 506.06, 511, 52/513, 489.2
See application file for complete search history.

(56) References Cited

U.S. PATENT DOCUMENTS

| | | | | |
|---|---|---|---|---|
| 2,831,222 | A * | 4/1958 | Anderson | 52/489.1 |
| 5,860,257 | A * | 1/1999 | Gerhaher et al. | 52/235 |
| 6,055,787 | A * | 5/2000 | Gerhaher et al. | 52/546 |
| 6,226,947 | B1 * | 5/2001 | Bado et al. | 52/483.1 |
| 6,289,644 | B1 * | 9/2001 | Gerhaher | 52/235 |
| 6,289,646 | B1 * | 9/2001 | Watanabe | 52/506.01 |
| 6,460,311 | B1 * | 10/2002 | Ito | 52/489.1 |
| 7,096,629 | B1 * | 8/2006 | Cox | 52/235 |
| 7,540,119 | B2 * | 6/2009 | Milburn | 52/235 |
| 7,726,083 | B2 * | 6/2010 | Wagner | 52/235 |
| 7,730,693 | B2 * | 6/2010 | Schrotenboer | 52/650.3 |
| 7,918,065 | B2 * | 4/2011 | Ito | 52/506.05 |

FOREIGN PATENT DOCUMENTS

| | | | |
|---|---|---|---|
| JP | 04149339 | A * | 5/1992 |
| JP | 05044286 | A * | 2/1993 |
| JP | 06057888 | A * | 3/1994 |
| JP | 06173417 | A * | 6/1994 |
| JP | 06316992 | A * | 11/1994 |

* cited by examiner

*Primary Examiner* — Phi Dieu Tran A
(74) *Attorney, Agent, or Firm* — Richard K Thomson

(57) ABSTRACT

A suspension system secures thin, light-weight, monolithic panels which appear as adjacent courses of brick to be suspended adjacent a substrate in a manner permitting sliding movement in the x-direction while inhibiting motion in the y- and z-directions, and, such that air can circulate behind the panel to prevent mold growth. The primary suspension hardware is an H-shaped channel with two vertically extending arms which secure the panels at the desired spaced position from the substrate.

12 Claims, 3 Drawing Sheets

FAUX BRICK WITH SUSPENSION SYSTEM

BACKGROUND AND SUMMARY OF THE INVENTION

The present invention is directed to building construction. More particularly, the present invention is directed to a thin-walled monolithic panel with a suspension system to attach it to, and stand it off from, a substrate.

Currently, if a builder or homeowner wants a house sporting the look of brick, s/he has basically two options: actual masonry construction, or installing a face brick utilizing a suspension grid. These systems are hard to install, are comparatively expensive and involve heavy construction materials. It is an object of the present invention to provide a monolithic, light-weight thin-walled composite panel configured to look like brick. Many composite siding systems suffer from the problem of trapping moisture behind the panel which provides a breeding ground for mold growth. The suspension system of the present invention provides adequate standoff from the attachment substrate to permit airflow which dries out any moisture which finds its way behind the panels, preventing mold growth.

The present invention is directed to a suspension system for securing siding to a substrate, the siding including a plurality of panels each panel extending horizontally along an x-axis, vertically along a y-axis, and being capable of movement out of plane relative to the substrate along a z-axis, the suspension system comprising a) first support means underlying a bottom edge of a siding panel holding the bottom edge at a first distance from the substrate and supporting the siding panel; b) second support means for engaging an upper edge of the siding panel and retaining the upper edge at a second spaced distance from the substrate; whereby the first and second support means i) maintain adequate space between the siding panel and the substrate to enable moisture to escape and circulating air to dry out any residual moisture which migrates behind the siding panel; and, ii) limit relative vertical movement along the y-axis between the siding and the substrate, limit relative movement along the z-axis between the siding and the substrate, while enabling the siding panel to experience lateral movement relative to the substrate along the x-axis.

The first support means preferably comprises an H-shaped channel which has a first vertical arm with a first primary axis, a first horizontal arm extending in a first direction from a mid-portion of the first vertical arm, a second vertical arm extending from a distal end of the first horizontal arm, the first horizontal arm having a second primary axis extending parallel to the first primary axis, and spacer means extending in a second direction from the first vertical arm to, together with a thickness of the first vertical arm, provide the first distance from the substrate. The second direction is preferably directly opposite to the first direction. The spacer means includes a first series of buttons extending outwardly in a row proximate an upper edge of the first vertical arm. Preferably, each of the buttons is oval having a primary axis extending along the primary axis of the H-shaped channel. Each of the first series of buttons is hollow. The spacer means further includes a second series of buttons extending outwardly in a row proximate a lower edge of the first vertical arm. Each of the buttons of the second series of buttons is oval having a primary axis extending perpendicular to the first primary axis. Each of the buttons of the second series of buttons is solid.

The first vertical arm has a series of cutouts to reduce an amount of material utilized in making the H-shaped channel. The series of cutouts includes a first group of upper cut outs and a second group of lower cutouts. The second vertical arm comprises a first set of upwardly directed arm sections extending upwardly from the first horizontal arm opposite the first group of upper cutouts. The second vertical arm further comprises a second set of downwardly directed arm sections extending downwardly from the first horizontal arm opposite the second group of lower cutouts. The first set of upwardly directed arm sections engage lower portions of a first set of siding panels restraining their movement along the z-axis, while the second set of downwardly directed arm sections engage upper portions of a second set of siding panels restraining their movement along the z-axis.

Another aspect of the invention includes a siding system comprising a) a light-weight, monolithic composite panel, the monolithic composite panel having thin walls configured to give the appearance of three-dimensional brick having a dimension along each of an x-axis, a y-axis and a z-axis; b) a suspension system for attaching the light-weight, monolithic composite panel to a substrate, the suspension system spacing the monolithic composite panel from the substrate preventing movement along the y-axis and the z-axis while allowing lateral movement along the x-axis. The panel includes a series of rows of bricks, adjacent the rows of bricks having varying lengths forming spaces, whereby an adjacent composite panel will have offset simulated bricks which interdigitate with said spaces. A specialty panel for corners is provided having a first group of simulated bricks extending in a first direction and a second group of simulated bricks extending in a second orthogonal direction.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
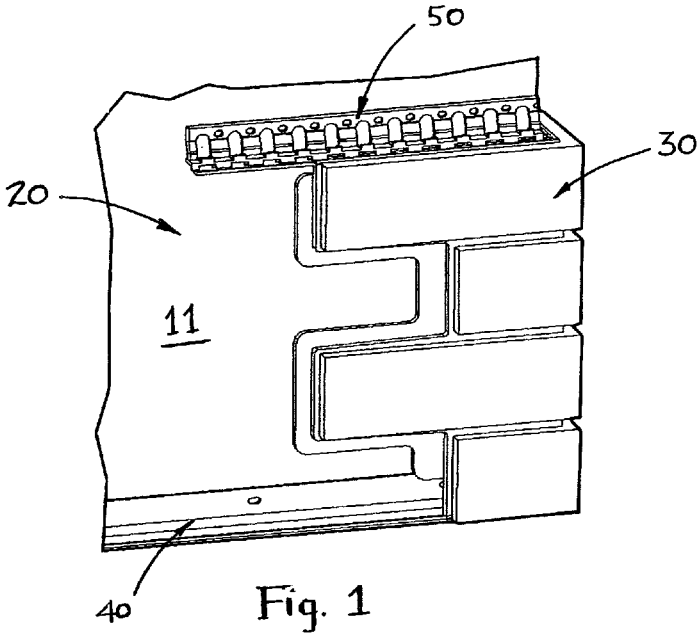
FIG. 1 is a perspective front view of a first embodiment of a corner panel of the faux face brick with suspension system of the present invention.
Figure 2A:
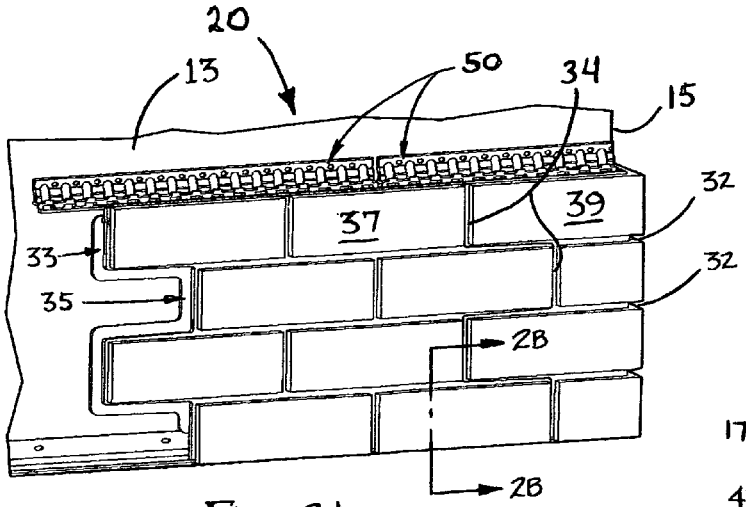
FIG. 2A is a perspective front view showing a standard panel installed adjacent the corner panel.
Figure 2B:
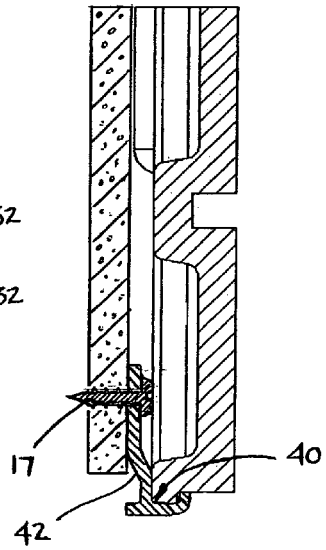
FIG. 2B is a schematic cross-sectional side view taken along line 2B-2B in FIG. 2A.
Figure 3:
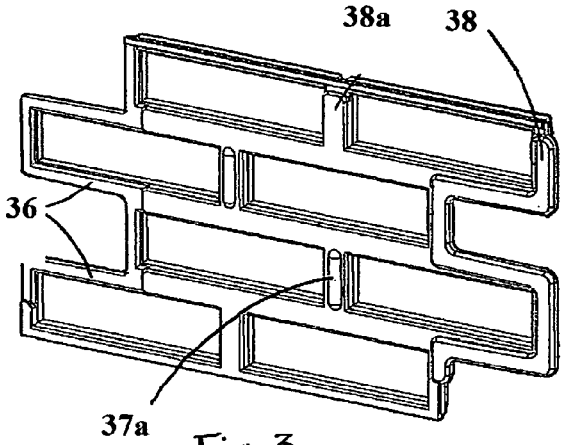
FIG. 3 is a rear perspective view of the standard panel in the first embodiment.

A first embodiment of the faux brick with suspension system of the present invention is depicted in FIGS. 1-2 generally at 20. Faux brick with suspension system 20 includes a thin, light-weight monolithic panel 30 secured to a substrate 11 using a J-channel 40 and an H-shaped channel 50. The panel 30 is molded to simulate a brick appearance having longitudinally extending recesses 32 to mimic the space between adjacent courses 33, 35 of bricks (FIG. 2A) and vertically extending recesses 34 to simulate the spaces between one brick 37 and an adjacent brick 39 in the same course. Both the front and the back of each panel 30 has three levels. As best seen in FIG. 3, the longitudinally extending recesses 32 are broadened on the back side as at 36 as are the vertical recesses as at 38 to effectively reinforce the monolithic panel 30 giving it some stiffness. An intermediate level 38*a* extends between 36 and 38 and extends around most of the rear surfaces of bricks 39*a*. The panels 30, constructed of up to 60% recycled gypsum combined with high-density polymers, can withstand all types of weather and be installed in virtually any climate at any time of year with considerably less cost than conventional masonry. To complete the faux-brick look, typically, mortar (not shown) will be troweled into the recesses 32, 34 after all the panels have been installed on substrate 11. When assembled, portion 36 will overlie portion 38 of an adjacent panel 30. Intermediate rib 37*a* provides a contact point should a force be directed against the front of the panel 30 after installation, preventing the panel from bowing too much which could cause cracking.

Figure 4:
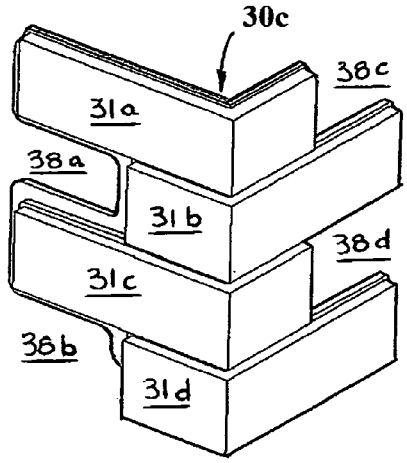
FIG. 4 is perspective front view of a corner panel of the first embodiment.
Figure 5:
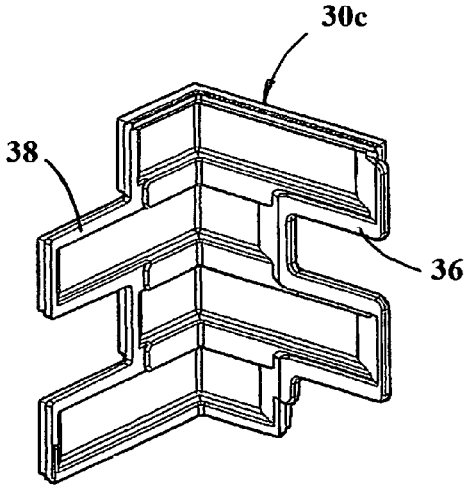
FIG. 5 is a perspective rear view of the corner panel.

As seen in FIGS. 4-5, corner panel 30*c* simulates four bricks 31*a*, 31*b*, 31*c*, and 31*d* being stacked in an alternating directional pattern as is typical of conventional masonry installation. These alternating bricks form spaces 38*a*, 38*b*, 38*c*, and 38*d* which can receive bricks of adjacent panels 30. As seen in FIG. 2A, the corner panel 30*c* may be trimmed if the substrate 11 forms a pseudo corner rather than continuing along the side of the building. However, more typically, installation of the corner panel 30*c* will permit the faux brick with suspension system 20 to be continued in both directions along the faces 13, 15 of substrate 11. The formation of broadening ribs 36 and 38 are continued on the rear of corner panel 30*c* (FIG. 5) in the same manner as conventional panel 30.

Figure 7:
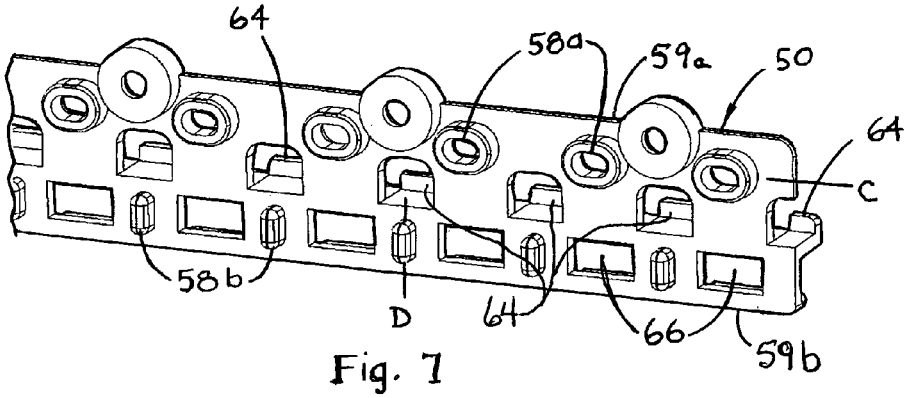
FIG. 7 is a perspective rear view of the H-shaped channel.
Figure 6:
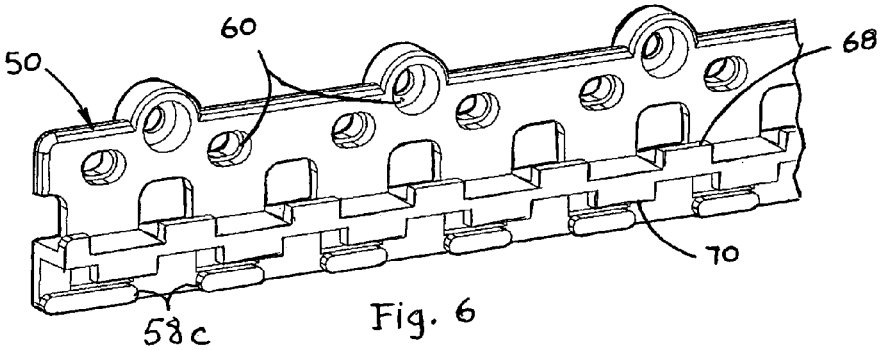
FIG. 6 is a perspective front view of an H-shaped channel used to suspend the faux brick in the first embodiment.
Figure 8:
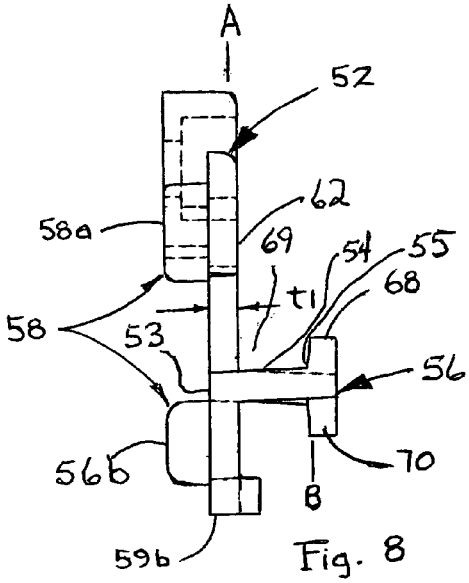
FIG. 8 is a side view of the H-shaped channel.

J-channel 40 is a starter channel which is used only to suspend the first course. The vertical arm 42 (FIG. 2B) of J-channel 40 will be nailed, or more preferably, fastened with threaded fasteners 17 as shown in FIG. 2B. Hook arm 44 extends along a bottom portion of vertical arm 42 to support panels 30. Once the corner panel 30*c* and first adjacent panel 30 are installed, the J-channel 40 and H-shaped channel 50 (FIG. 1) can be run out to facilitate the installation of the next panel 30, preferably once again, using threaded fasteners. The details of H-shaped channel 50 are seen more clearly in FIGS. 6-8. H-shaped channel 50 has a first vertical arm 52 having a first primary axis A, first horizontal arm 54 extending in a first direction from a mid-portion 53 of said first vertical arm 52. Second vertical arm 56 extends from a distal end 55 of first horizontal arm 54, second vertical arm 56 having a second primary axis B extending parallel to first primary axis A, and spacer means 58 extending in a second direction from first vertical arm 52 to, together with a thickness $t_1$ of said first vertical arm, provide said first distance from the substrate 11. The second direction is preferably directly opposite to the first direction in which horizontal arm 54 extends.

Spacer means 58 includes first a first series of buttons 58*a* extending outwardly in a row proximate an upper edge 59*a* of first vertical arm 52. Each button 58*a* is oval having its primary axis C extending horizontally along the vertical arm 52 of H-shaped channel 50. Buttons 58*a* are hollow accommodating the threaded fasteners used to attach channel 50 to substrate 11. A countersunk bearing surface 60 housed within button 58*a* allows the head of the threaded fastener to lie below or even with the surface 62 of channel 50. Spacer means further comprises a second series of buttons 58*b* extending outwardly in a row proximate a lower edge 59*b* of first vertical arm 52. Each of the buttons 58*b* of the second series of buttons is oval having a primary axis D extending perpendicular to the first primary axis of first series of buttons 58*a* and is preferably solid. A first series of cutouts includes upper row or group of cutouts 64 which extend across the middle of first vertical arm 52 and a second lower row or group of cutouts 66 which are offset laterally from first group of cutouts 64. Cutouts 64, 66 reduce the quantity of material needed to manufacture channel 50 without compromising its structural integrity. A third series of buttons 58*c* (FIG. 6) extend across the front surface extending beneath cutouts 66.

A second vertical arm is formed by a first group of upwardly directed arm sections 68 which are opposite the first group of cutouts 64 and a second group of downwardly directed arm sections 70 opposite the second group of cutouts 66. After the initial panel course is mounted using J channel 40, H-shaped channel 50 will be used exclusively to mount panels 30. Panels 30 have an x-, a y-, and a z-axis and, in and of themselves, are capable of movement along each of these axes. However, horizontally extending arm 34 inhibits movement in the y-direction while second vertical arm sections 68 and 70 inhibit movement in the z-direction for a bottom portion of a panel 30 of a first upper course and a top portion of a panel 30 of a second lower course. Mounting assembly 40, 50 permit panel 30 to move laterally along its x-axis to facilitate installation and engagement of one panel section with an adjacent panel 30. In addition, the movement along the x-axis permits some thermal expansion as the panel 30 is heated by the sun. Further, panels 30 are spaced laterally from the substrate 11 by a distance equal to the thickness of buttons 58*a*, 58*b* plus the thickness $t_1$ of the first vertical arm 52. There is no direct contact between the panels 30 and substrate 11 so air can readily circulate behind the panels, drying out any moisture which might otherwise accumulate there and avoiding the growth of mold. In addition, with the mounting system 40, 50, there are no exposed fasteners affording both an aesthetic as well as functional advantage.

As best seen in FIG. 2B, J-channel 40 supports the lower edge of a first course of monolithic panels 30, while H-channel 50 captures an upper nose 31 of panel 30 between third row of buttons 58*c* and downward vertical arms 70. This engagement prevents movement along the y-axis and z-axis while permitting sliding movement along the x-axis, as may be needed for installation, to properly position adjacent panels 30. Buttons 58*b* which, it will be recalled, have a narrow profile, permit airflow through pocket 61 to enable moisture to move freely behind panel 30 and permit drying so that mold/mildew does not grow on substrate 11. Upwardly directed vertical sections 68 define a pocket 69 which will support a second course of panels 30 (not shown) to be subsequently installed.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A suspension system for securing siding to an underlying substrate, the siding including a plurality of panels each panel extending horizontally along an x-axis, vertically along a y-axis, and being capable of movement out of plane relative to the substrate along a z-axis, said suspension system comprising:

a) first continuous support means underlying a bottom edge of a siding panel holding said bottom edge at a first distance from the substrate and supporting the siding panel, said first continuous support means being secured directly to the underlying substrate, said first continuous support means comprising an H-shaped channel, said H-shaped channel having a first interrupted vertical arm having a first primary axis, a first continuous horizontal arm extending in a first direction from a mid-portion of said first vertical arm, a second interrupted vertical arm extending from a distal end of said first horizontal arm, said second vertical arm having a second primary axis extending parallel to said first primary axis, and spacer means extending in a second direction from said first vertical arm to, together with a thickness of said first vertical arm, define said first distance from the substrate, wherein said spacer means comprise a first series of buttons extending outwardly in a row proximate an upper edge of said first vertical arm;

b) second continuous support means for engaging an upper edge of the siding panel and retaining the upper edge at a second spaced distance from the substrate, wherein said second continuous support means is secured directly to the underlying substrate and is identical to said first continuous support means;

whereby said first and second support means i) maintain a first distance between the siding panel and the substrate to enable moisture to escape and circulating air to dry out any residual moisture which migrates behind the siding panel; and, ii) limit relative vertical movement along the y-axis between the siding and the substrate, limit relative movement along the z-axis between the siding and the substrate, while enabling the siding panel to experience lateral movement relative to the substrate along the x-axis.

2. The suspension system of claim 1 wherein said second direction is directly opposite to said first direction.

3. The suspension system of claim 1 wherein each said buttons is oval having a primary axis extending horizontally along said first vertical arm of said H-shaped channel.

4. The suspension system of claim 3 wherein each said button of said first series of buttons is hollow.

5. The suspension system of claim 1 wherein said spacer means further comprises a second series of buttons extending outwardly in a row proximate a lower edge of said first vertical arm.

6. The suspension system of claim 5 wherein each of said buttons of said second series of buttons is oval having a primary axis extending perpendicular to said primary axis of said first series of buttons.

7. The suspension system of claim 6 wherein each of said buttons of said second series of buttons is solid.

8. A suspension system for securing siding to an underlying substrate, the siding including a plurality of panels each panel extending horizontally along an x-axis, vertically along a y-axis, and being capable of movement out of plane relative to the substrate along a z-axis, said suspension system comprising:

a) first continuous support means underlying a bottom edge of a siding panel holding said bottom edge at a first distance from the substrate and supporting the siding panel, said first continuous support means being secured directly to the underlying substrate, wherein said first support means comprises an H-shaped channel, said H-shaped channel having a first interrupted vertical arm having a first primary axis, a first continuous horizontal arm extending in a first direction from a mid-portion of said first vertical arm, a second interrupted vertical arm extending from a distal end of said first horizontal arm, said second vertical arm having a second primary axis extending parallel to said first primary axis, and spacer means extending in a second direction from said first vertical arm to, together with a thickness of said first vertical arm, define said first distance from the substrate wherein said first vertical arm has a series of cutouts to reduce an amount of material utilized in making said H-shaped channel;

b) second continuous support means for engaging an upper edge of the siding panel and retaining the upper edge at a second spaced distance from the substrate, wherein said second continuous support means is secured directly to the underlying substrate and is identical to said first continuous support means;

whereby said first and second support means i) maintain a first distance between the siding panel and the substrate to enable moisture to escape and circulating air to dry out any residual moisture which migrates behind the siding panel; and, ii) limit relative vertical movement along the y-axis between the siding and the substrate, limit relative movement along the z-axis between the siding and the substrate, while enabling the siding panel to experience lateral movement relative to the substrate along the x-axis.

9. The suspension system of claim 8 wherein said series of cutouts includes a first group of upper cut outs and a second group of lower cutouts.

10. The suspension system of claim 9 wherein said second vertical arm comprises a first set of upwardly directed arm sections extending upwardly from said first horizontal arm opposite said first group of upper cutouts.

11. The suspension system of claim 10 wherein said second vertical arm further comprises a second set of downwardly directed arm sections extending downwardly from said first horizontal arm opposite said second group of lower cutouts.

12. The suspension system of claim 11 wherein said first set of upwardly directed arm sections engage lower portions of a first set of siding panels restraining their movement along said z-axis, while said second set of downwardly directed arm sections engage upper portions of a second set of siding panels restraining their movement along said z-axis.

* * * * *